US011739408B1

(12) United States Patent
Hu et al.

(10) Patent No.: US 11,739,408 B1
(45) Date of Patent: Aug. 29, 2023

(54) HEAT TREATMENT METHOD FOR REALIZING GRAIN BOUNDARY SERRATION IN NICKEL-BASED SUPERALLOY FORGING

(71) Applicant: Shanghai Dianji University, Shanghai (CN)

(72) Inventors: Honglei Hu, Shanghai (CN); Fenghua Cao, Shanghai (CN); Zhisong Li, Shanghai (CN); Xiao Xu, Shanghai (CN); Yifei Gui, Shanghai (CN)

(73) Assignee: SHANGHAI DIANJI UNIVERSITY, Shanghai (CN)

( * ) Notice: Subject to any disclaimer, the term of this patent is extended or adjusted under 35 U.S.C. 154(b) by 0 days.

(21) Appl. No.: 18/171,454

(22) Filed: Feb. 20, 2023

(30) Foreign Application Priority Data

Mar. 11, 2022 (CN) ..... 202210241473.5

(51) Int. Cl.
*C22F 1/10* (2006.01)
*C22C 19/05* (2006.01)

(52) U.S. Cl.
CPC ..... *C22F 1/10* (2013.01); *C22C 19/055* (2013.01)

(58) Field of Classification Search
CPC ..... C22F 1/10; C22C 19/055
See application file for complete search history.

(56) References Cited

FOREIGN PATENT DOCUMENTS

WO WO-2018111566 A1 * 6/2018 ..... C22C 19/055

* cited by examiner

*Primary Examiner* — Jessee R Roe
(74) *Attorney, Agent, or Firm* — McDonnell Boehnen Hulbert & Berghoff LLP

(57) ABSTRACT

The present disclosure provides a heat treatment method for realizing grain boundary serration in a nickel-based superalloy forging, including introducing a serrated grain boundary into a microstructure of a nickel-based superalloy forging by using a heat treatment method for controlling a cooling rate; the heat treatment method for controlling cooling speed includes the following steps: step S1: holding the nickel-based superalloy forging for 0.5-4 h at 1,050-1,200° C.; step S2: cooling the nickel-based superalloy forging to 650-800° C. at a preset cooling rate, and holding for 1-8 h, where the preset cooling rate is 1-20° C/min; and step S3, taking out and cooling the nickel-based superalloy forging to room temperature with water. The heat treatment method for realizing grain boundary serration in a nickel-based superalloy forging provided by the present disclosure can realize the grain boundary serration in the nickel-based superalloy forging.

6 Claims, 1 Drawing Sheet

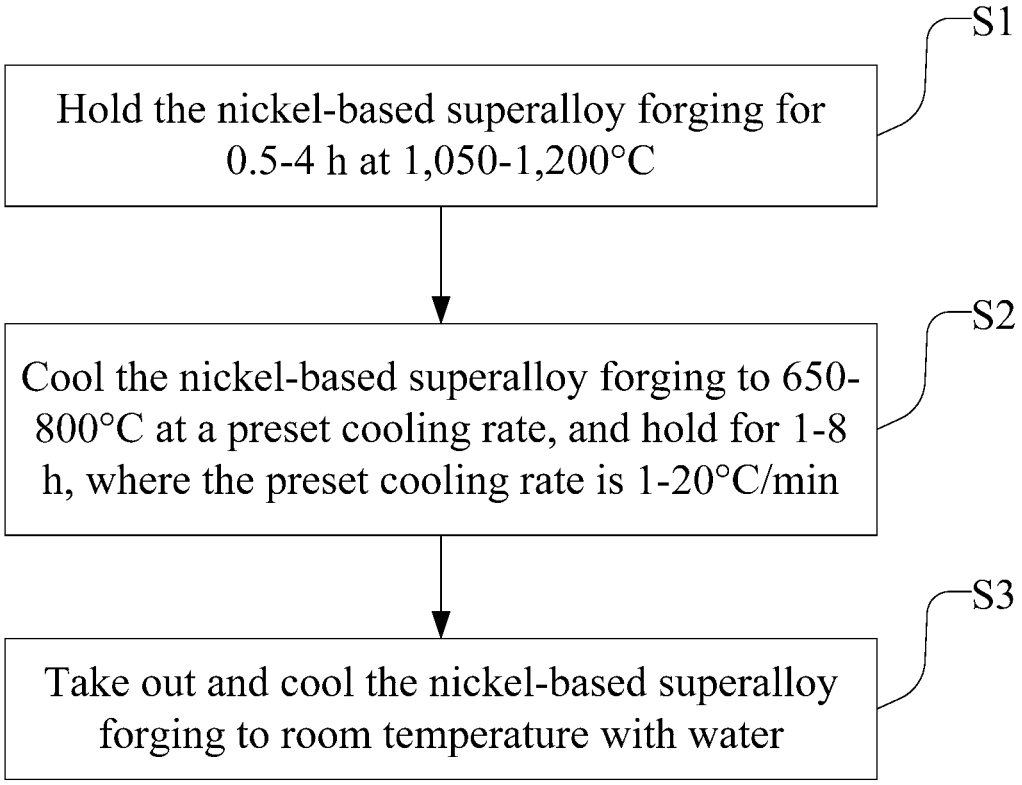
S1
Hold the nickel-based superalloy forging for 0.5-4 h at 1,050-1,200°C
S2
Cool the nickel-based superalloy forging to 650-800°C at a preset cooling rate, and hold for 1-8 h, where the preset cooling rate is 1-20°C/min
S3
Take out and cool the nickel-based superalloy forging to room temperature with water

HEAT TREATMENT METHOD FOR REALIZING GRAIN BOUNDARY SERRATION IN NICKEL-BASED SUPERALLOY FORGING

CROSS REFERENCE TO RELATED APPLICATION

This patent application claims the benefit and priority of Chinese Patent Application No. 202210241473.5, filed with the China National Intellectual Property Administration on Mar. 11, 2022, the disclosure of which is incorporated by reference herein in its entirety as part of the present application.

FIELD

The present disclosure relates to the field of heat treatment of nickel-based superalloy forgings, in particular to a heat treatment method for realizing grain boundary serration in a nickel-based superalloy forging.

BACKGROUND

At present, thermal power is still the main electric power resource in the world. In order to improve thermal efficiency, thermal power is gradually developing from subcriticality to supercriticality, and then to ultra-supercriticality. The steam pressure is up to 30-35 MPa, and the steam temperature is up to 593-600° C. or higher. In high temperature, high pressure, high humidity and acidic environments, in addition to requiring high strength and high temperature resistance of valve bodies and pipe fittings, the valve bodies are further required to have excellent resistance to high temperature grain boundary corrosion and stress corrosion resistance. Inconel 617 alloy has excellent high temperature strength, plasticity, oxidation resistance, and corrosion resistance, so the alloy is often used as superheaters and reheaters in ultra-supercritical units.

However, during elevated temperature's service, because the grain boundary is a typical planar defect, it will produce many failure behaviors such as: intergranular corrosion, stress corrosion, high temperature creep, stress rupture, and fatigue failure, which will endanger production safety seriously. Therefore, how to improve the properties of alloys by regulating grain boundaries has always been paid attention to by researchers inside and outside of China.

Serrated grain boundary is a special grain boundary that improves grain boundary properties by changing the grain boundary structure—transforming a straight grain boundary into a serrated grain boundary. It should be pointed out that the formation mechanism of the serrated grain boundary is still unclear at present, and the formation mechanism is different in different alloy systems. However, it is clear that the grain boundary energy of the serrated grain boundary is lower than that of the straight random grain boundary, which can effectively improve the segregation of elements at the grain boundary and the precipitation morphology of carbides at the grain boundary. Thus, the grain boundary corrosion, intergranular crack initiation and propagation are inhibited, and the creep fatigue and welding properties of the alloy are improved.

Therefore, from the perspective of grain boundaries, without changing the alloy composition and without affecting the mechanical properties of the material, it is especially important that the straight grain boundaries in the forgings are transformed into serrated grain boundaries through a simple heat treatment method to improve the service performance of the material. This patent realizes grain boundary serration in nickel-based superalloy forgings through an appropriate heat treatment process, so as to achieve the objective of grain boundary regulation, which is of great significance to further improve the alloy durability, creep, fatigue and welding properties.

SUMMARY

In view of the above deficiencies in the prior art, the present disclosure provides a heat treatment method for realizing grain boundary serration in a nickel-based superalloy forging, which can realize the grain boundary serration in the nickel-based superalloy forging.

To achieve the above objective, the present disclosure provides a heat treatment method for realizing grain boundary serration in a nickel-based superalloy forging, including introducing a serrated grain boundary into a microstructure of the nickel-based superalloy forging by using a heat treatment method for controlling a cooling rate, where the heat treatment method for controlling a cooling rate includes the following steps:

step S1: holding the nickel-based superalloy forging for 0.5-4 h at 1,050-1,200° C.;

step S2: cooling the nickel-based superalloy forging to 650-800° C. at a preset cooling rate, and holding for 1-8 h, where the preset cooling rate is 1-20° C/min; and step S3: taking out and cooling the nickel-based superalloy forging to room temperature with water; where the nickel-based superalloy forging includes the following components: Cr: 20.0-24.0% by weight, Co: 10.0-15.0% by weight, Mo: 8.0-10.0% by weight, Fe: ≤3.0% by weight, Mn: ≤1.0% by weight, Si: ≤1.0% by weight, Al: 0.8-1.5% by weight, Ti: ≤0.6% by weight, C: 0.05-0.15% by weight, and the balance being Ni.

Preferably, a designation of the nickel-based superalloy forging is Inconel 617.

Preferably, the heat treatment method for controlling a cooling rate is carried out in a heat treating furnace capable of controlling the cooling rate.

Preferably, the heat treatment method for controlling a cooling rate promotes grain boundary segregation of Mo, Cr and C in the nickel-based superalloy forging during controlled cooling, produces plate-like $M_6C$ and $M_{23}C_6$ at the grain boundary, has a dragging effect on the migration of the grain boundary, and forms the serrated grain boundary between grains.

Preferably, an average amplitude of the serrated grain boundary in the nickel-based superalloy forging may be greater than 1 μm.

Preferably, room temperature mechanical properties of the nickel-based superalloy forging are tested with reference to GB/T 228.1 Metallic Materials—Tensile Testing—Part 1: Method of Test at Room Temperature.

The present disclosure has the following beneficial effects due to the adoption of the above technical solution:

1. On the premise of not changing the alloy composition, the present disclosure can transform some straight grain boundaries into serrated grain boundaries in the nickel-based superalloy forging only through a simple controlled cooling heat treatment method, and has the advantages of simple process and easy realization.
2. For the nickel-based superalloy forging treated by the method provided by the present disclosure, the average amplitude of the serrated grain boundary in the alloy is at least 1 μm. By introducing the serrated grain boundary, the grain boundary strength is improved and the grain boundary characteristic distribution is optimized.

3. The nickel-based superalloy forging treated by the method provided by the present disclosure obtains mechanical properties not lower than those of conventionally treated alloys while introducing serrated grain boundaries. The yield strength is at least 300 MPa, the tensile strength is at least 680 MPa, and the percentage extension is at least 50%.

BRIEF DESCRIPTION OF THE DRAWINGS

FIG. 1 is a flow chart of a heat treatment method for realizing grain boundary serration in a nickel-based superalloy forging in the examples of the present disclosure.

DETAILED DESCRIPTION

Preferred examples of the present disclosure are given and described below in detail with reference to FIG. 1, so that the functions and characteristics of the present disclosure can be better understood.

As shown in FIG. 1, the examples of the present disclosure provides a heat treatment method for realizing grain boundary serration in a nickel-based superalloy forging, including introducing a serrated grain boundary into a microstructure of the nickel-based superalloy forging by using a heat treatment method for controlling a cooling rate; the heat treatment method for controlling a cooling rate includes the following steps:

step S1: holding the nickel-based superalloy forging for 0.5-4 h at 1,050-1,200° C.;

step S2: cooling the nickel-based superalloy forging after treatment to 650-800° C. at a preset cooling rate, and holding for 1-8 h, where the preset cooling rate is 1-20° C/min; and step S3: taking out and cooling the nickel-based superalloy forging to room temperature with water; where the nickel-based superalloy forging includes the following components: Cr: 20.0-24.0% by weight, Co: 10.0-15.0% by weight, Mo: 8.0-10.0% by weight, Fe: ≤3.0% by weight, Mn: ≤1.0% by weight, Si: ≤1.0% by weight, Al: 0.8-1.5% by weight, Ti: ≤0.6% by weight, C: 0.05-0.15% by weight, and the balance being Ni.

A designation of the nickel-based superalloy forging is Inconel 617.

The heat treatment method for controlling a cooling rate is carried out in a heat treating furnace capable of controlling the cooling rate.

The heat treatment method for controlling a cooling rate promotes grain boundary segregation of Mo, Cr and C in the nickel-based superalloy forging during controlled cooling, produces plate-like $M_6C$ and $M_{23}C_6$ at the grain boundary, has a dragging effect on the migration of the grain boundary, and forms the serrated grain boundary between grains.

An average amplitude of the serrated grain boundary in nickel-based superalloy forging is greater than 1 μm.

Room temperature mechanical properties of the nickel-based superalloy forging are tested with reference to GB/T 228.1 Metallic Materials—Tensile Testing—Part 1: Method of Test at Room Temperature.

Example 1:

In the present example, the heat treatment for controlling a cooling rate (hereinafter referred to as: controlled cooling heat treatment) is conducted on the Inconel 617 nickel-based superalloy forging after forging and forming. Some straight random grain boundaries were transformed into serrated grain boundaries, and the average amplitude of the serrated grain boundary was 1 μm. A specific implementation process was as follows:

1. The Inconel 617 nickel-based superalloy forging after forging and forming was placed in a heat treating furnace, and held for 0.5-4 h (1 h in this example) at 1,050-1,200° C. (1,200° C. in this example).
2. The Inconel 617 nickel-based superalloy forging in step 1 was placed in the heat treating furnace, cooled to 650-800° C. (750° C. in this example) at a certain cooling rate of 1-20° C/min (10° C/min in this example), and held for 1-8 h (8 h in this example).
3. The Inconel 617 nickel-based superalloy forging in step 2 was taken out and cooled to room temperature with water.
4. Samples were cut from the Inconel 617 nickel-based superalloy after water cooling in step 3, and analyzed by scanning electron microscopy (SEM). Compared with conventional treatment (without controlled cooling heat treatment), some straight grain boundaries were transformed into serrated grain boundaries in the Inconel 617 nickel-based superalloy forging after the controlled cooling heat treatment, and $M_{23}C_6$ and $M_6C$ carbides were precipitated at the grain boundaries. The average amplitude of the serrated grain boundary was greater than 1 μm (the average amplitude in this example was 1.5 μm).
5. The Inconel 617 nickel-based superalloy forging treated by water cooling in step 3 was processed into M10 threaded rods, and the mechanical properties were tested with reference to GB/T 228.1 Metallic Materials—Tensile Testing—Part 1: Method of Test at Room Temperature. The results are shown in Table 1.

After the Inconel 617 nickel-based superalloy forging in this example was subjected to the controlled cooling heat treatment (holding for 1 h at 1,200° C., cooling to 750° C. at a cooling rate of 10° C/min and holding for 8 h, taking out and cooling to room temperature with water), some straight grain boundaries were transformed into serrated grain boundaries. The average amplitude of the serrated grain boundary was 1.5 μm. The room temperature mechanical properties of the alloy were not influenced while introducing the serrated grain boundaries.

Table 1. Mechanical properties of Inconel 617 nickel-based superalloy in the first controlled cooling heat treatment

| No. | $\sigma_b$/MPa | $\sigma_{0.2}$/MPa | δ/% | Controlled cooling process |
|---|---|---|---|---|
| 1 | 800 | 312 | 60 | Holding for 1 h at 1,200° C. |
| 2 | 805 | 315 | 61 | Cooling rate 10° C./min |
| 3 | 803 | 316 | 61 | 750° C. Holding for 8 h |
| Average | 802.6 | 314.3 | 60.7 | Water cooling |

Example 2:

It was basically the same as Example 1. There were the following differences: the controlled cooling heat treatment process was holding for 1.5 h at 1,100° C., cooling to 700° C. at a cooling rate of 6° C/min, holding for 6 h, taking out and cooling to room temperature with water; and the average amplitude of the serrated grain boundary in the alloy was 1.1 μm.

The Inconel 617 nickel-based superalloy with the same chemical composition as in Example 1 was used for controlled cooling heat treatment. The alloy was placed in a heat treating furnace, held for 1.5 hat 1,100° C., cooled to 700°

C. at a cooling rate of 6° C/min, held for 6 h, taken out and cooled to room temperature with water. The grain boundary structure was analyzed by SEM, and the results showed that the average amplitude of the serrated grain boundary in the alloy was 1.1 μm. The Inconel 617 nickel-based superalloy forging after controlled cooling heat treatment was processed into M10 threaded rods, and the mechanical properties were tested with reference to GB/T 228.1 Metallic Materials—Tensile Testing—Part 1: Method after of Test at Room Temperature. The results are shown in Table 2.

Table 2. Mechanical properties of Inconel 617 nickel-based superalloy in the second controlled cooling heat treatment

| No. | $\sigma_b$/MPa | $\sigma_{0.2}$/MPa | δ/% | Controlled cooling process |
|---|---|---|---|---|
| 1 | 798 | 306 | 63 | Holding for 1.5 h at 1,100° C. |
| 2 | 794 | 304 | 62 | Cooling rate 6° C./min |
| 3 | 800 | 310 | 63 | 700° C. Holding for 6 h |
| Average | 797.3 | 306.7 | 62.7 | Water cooling |

After the Inconel 617 nickel-based superalloy forging in this example was subjected to the controlled cooling heat treatment (holding for 1.5 h at 1,100° C., cooling to 700° C. at a cooling rate of 6° C/min and holding for 6 h, taking out and cooling to room temperature with water), some straight grain boundaries were transformed into serrated grain boundaries. The average amplitude of the serrated grain boundary was 1.1 μm. The room temperature mechanical properties of the alloy were not influenced while introducing the serrated grain boundaries.

Example 3:

It was basically the same as Example 1. There were the following differences: the controlled cooling heat treatment was holding for 1 h at 1,150° C., cooling to 650° C. at a cooling rate of 8° C/min, holding for 4 h, taking out and cooling to room temperature with water; and the average amplitude of the serrated grain boundary in the alloy was 1.2 μm.

The Inconel 617 nickel-based superalloy with the same chemical composition as in Example 1 was used for controlled cooling heat treatment. The alloy was placed in a heat treating furnace, held for 1 h at 1,150° C., cooled to 650° C. at a cooling rate of 8° C/min, held for 4 h, taken out and cooled to room temperature with water. The grain boundary structure was analyzed by SEM, and the results showed that the average amplitude of the serrated grain boundary in the alloy was 1.2 μm. The Inconel 617 nickel-based superalloy forging after controlled cooling heat treatment was processed into M10 threaded rods, and the mechanical properties were tested with reference to GB/T 228.1 Metallic Materials—Tensile Testing—Part 1: Method after of Test at Room Temperature. The results are shown in Table 3.

Table 3. Mechanical properties of Inconel 617 nickel-based superalloy in the third controlled cooling heat treatment

| No | $\sigma_b$/MPa | $\sigma_{0.2}$/MPa | δ/% | Controlled cooling process |
|---|---|---|---|---|
| 1 | 796 | 306 | 64 | Holding for 1 h at 1,150° C. |
| 2 | 802 | 312 | 62 | Cooling rate 8° C./min |
| 3 | 800 | 308 | 63 | 650° C. Holding for 4 h |
| Average | 799.3 | 308.7 | 63 | Water cooling |

After the Inconel 617 nickel-based superalloy forging in this example was subjected to the controlled cooling heat treatment (holding for 1 h at 1,150° C., cooling to 650° C. at a cooling rate of 8° C/min and holding for 4 h, taking out and cooling to room temperature with water), some straight grain boundaries were transformed into serrated grain boundaries. The average amplitude of the serrated grain boundary was 1.2 μm. The room temperature mechanical properties were not influenced while introducing the serrated grain boundaries.

The results of the examples show that the objective of the present disclosure can be achieved within the range of the technical parameters of the technical solution of the present disclosure. Some straight grain boundaries of the forging are transformed into serrated grain boundaries, and room temperature mechanical properties are not influenced while introducing the serrated grain boundaries.

The present disclosure has been described in detail above with reference to the accompanying drawings and examples, and those skilled in the art can make various modifications to the present disclosure according to the above description. Therefore, some details in the examples should not be construed as limiting the present disclosure, and the present disclosure will take the scope defined by the appended claims as the protection scope of the present disclosure.

What is claimed is:

1. A heat treatment method for realizing grain boundary serration in a nickel-based superalloy forging, comprising introducing a serrated grain boundary into a microstructure of the nickel-based superalloy forging by using a heat treatment method for controlling a cooling rate, wherein the heat treatment method for controlling a cooling rate comprises the following steps:

step S1: holding the nickel-based superalloy forging for 0.5-4 h at 1,050-1,200° C.;

step S2: cooling the nickel-based superalloy forging to 650-800° C. at a preset cooling rate, and holding for 1-8 h, wherein the preset cooling rate is 1-20° C/min; and step S3: taking out and cooling the nickel-based superalloy forging to room temperature with water; wherein the nickel-based superalloy forging comprises the following components: Cr: 20.0-24.0% by weight, Co: 10.0-15.0% by weight, Mo: 8.0-10.0% by weight, Fe: ≤3.0% by weight, Mn: ≤1.0% by weight, Si: ≤1.0% by weight, Al: 0.8-1.5% by weight, Ti: ≤0.6% by weight, C: 0.05-0.15% by weight, and the balance being Ni.

2. The heat treatment method for realizing grain boundary serration in a nickel-based superalloy forging according to claim 1, wherein a designation of the nickel-based superalloy forging is Inconel 617.

3. The heat treatment method for realizing grain boundary serration in a nickel-based superalloy forging according to claim 1, wherein the heat treatment method for controlling a cooling rate is carried out in a heat treating furnace capable of controlling the cooling rate.

4. The heat treatment method for realizing grain boundary serration in a nickel-based superalloy forging according to claim 1, wherein the heat treatment method for controlling a cooling rate promotes grain boundary segregation of Mo, Cr and C in the nickel-based superalloy forging during controlled cooling, produces plate-like $M_6C$ and $M_{23}C_6$ at the grain boundary, has a dragging effect on the migration of the grain boundary, and forms the serrated grain boundary between grains.

5. The heat treatment method for realizing grain boundary serration in a nickel-based superalloy forging according to claim 1, wherein an average amplitude of the serrated grain boundary in the nickel-based superalloy forging is greater than 1 μm.

6. The heat treatment method for realizing grain boundary serration in a nickel-based superalloy forging according to claim 1, wherein room temperature mechanical properties of the nickel-based superalloy forging are tested with reference to GB/T 228.1 Metallic Materials—Tensile Testing—Part 1: Method of Test at Room Temperature.

* * * * *